US008261927B1

(12) United States Patent
Volzke et al.

(10) Patent No.: US 8,261,927 B1
(45) **Date of Patent: *Sep. 11, 2012**

(54) CONICAL HOLE PLUG

(76) Inventors: Lauren D. Volzke, Mina, SD (US); Dennis M. Volzke, Aberdeen, SD (US)

( * ) Notice: Subject to any disclaimer, the term of this patent is extended or adjusted under 35 U.S.C. 154(b) by 106 days.

This patent is subject to a terminal disclaimer.

(21) Appl. No.: 12/825,509

(22) Filed: Jun. 29, 2010

Related U.S. Application Data

(63) Continuation-in-part of application No. 11/839,203, filed on Aug. 15, 2007.

(51) Int. Cl.
*B65D 51/00* (2006.01)
*B65D 43/04* (2006.01)
*B65D 39/00* (2006.01)

(52) U.S. Cl. ..... 220/287; 220/239; 220/DIG. 19; 220/801; 215/355

(58) Field of Classification Search ..... 220/212, 220/287, 801, 796, 601, DIG. 19; 217/110, 217/113, 98; 215/355, 317, 319; 138/91, 138/89; 446/125
See application file for complete search history.

(56) References Cited

U.S. PATENT DOCUMENTS

| | | | | |
|---|---|---|---|---|
| 1,545,824 | A * | 7/1925 | Fischer | 217/110 |
| 3,724,223 | A * | 4/1973 | Pepe | 405/255 |
| 3,987,930 | A | 10/1976 | Fuson | |
| 4,645,096 | A | 2/1987 | Grant | |
| 6,033,170 | A | 3/2000 | Gold | |
| D455,652 | S | 4/2002 | Wyslotsky | |
| 7,476,228 | B2 | 1/2009 | Abdou | |
| 2008/0011375 | A1 | 1/2008 | Soubjaki | |

OTHER PUBLICATIONS

Caplugs; http://www.caplugs.com/defaultaspx; Buffalo, NY.

* cited by examiner

*Primary Examiner* — Robin Hylton
(74) *Attorney, Agent, or Firm* — Neustal Law Offices

(57) ABSTRACT

A conical hole plug for sealing various types of holes and openings. The conical hole plug generally includes a first elongated portion having a first varying diameter that uniformly increases from a terminating outer end to a terminating inner end, a second cavity extending within the first elongated portion, the second cavity having a second varying diameter that uniformly decreases from a terminating outer end to a terminating inner end, a second elongated portion having a third varying diameter that uniformly increases from a terminating outer end to a terminating inner end, the second elongated portion linearly extends from the first elongated portion, a first cavity extending within the second elongated portion, the first cavity having a fourth varying diameter that uniformly decreases from a terminating outer end to a terminating inner end.

19 Claims, 11 Drawing Sheets

REPLACEMENT SHEET

REPLACEMENT SHEET

REPLACEMENT SHEET

REPLACEMENT SHEET

CONICAL HOLE PLUG

CROSS REFERENCE TO RELATED APPLICATIONS

I hereby claim benefit under Title 35, United States Code, Section 120 of U.S. patent application Ser. No. 11/839,203 filed Aug. 15, 2007. This application is a continuation in-part of the Ser. No. 11/839,203 application filed on Aug. 15, 2007. The Ser. No. 11/839,203 application is currently pending. The Ser. No. 11/839,203 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to plugs and more specifically it relates to a conical hole plug for efficiently sealing various structured holes and openings.

2. Description of the Related Art

Any discussion of the related art throughout the specification should in no way be considered as an admission that such related art is widely known or forms part of common general knowledge in the field.

Hole plugs have been in use for years. Typically, hole plugs are utilized to seal a particular size hole or opening, wherein the plug is generally inserted within the hole or surrounds an outer perimeter of the hole. Plugs are generally manufactured in various structures to accommodate various structured openings, such as openings having different sizes or being threaded, uniform thickness, tapered thickness, smooth.

It can be difficult for a user to find the correct structured hole plug to efficiently seal a particular hole, wherein the plugs are generally manufactured to accommodate only one hole structure or else a very narrow range of hole structures. It can also be expensive for the user to buy a specific structure plug for each structure hole that is desired to be sealed. Because of the inherent problems with the related art, there is a need for a new and improved conical hole plug for efficiently sealing various structured holes and openings.

BRIEF SUMMARY OF THE INVENTION

A conical hole plug for efficiently sealing various structured holes and openings. The invention generally relates to a conical hole plug which includes a first elongated portion having a first varying diameter that uniformly increases from a terminating outer end to a terminating inner end, a second cavity extending within the first elongated portion, the second cavity having a second varying diameter that uniformly decreases from a terminating outer end to a terminating inner end, a second elongated portion having a third varying diameter that uniformly increases from a terminating outer end to a terminating inner end, the second elongated portion linearly extends from the first elongated portion, a first cavity extending within the second elongated portion, the first cavity having a fourth varying diameter that uniformly decreases from a terminating outer end to a terminating inner end.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a hole plug system for efficiently sealing various structured holes and openings.

Another object is to provide a hole plug system that does not require any adjusting.

Another object is to provide a hole plug system that does not include any moving parts.

Another object is to provide a hole plug system that may be utilized in a wide variety of industries, equipment and machinery (e.g. sandblasting, painting, maintenance, air conditioning, automobile mechanics, plumbing, etc.).

An additional object is to provide a hole plug system that is easy to utilize.

A further object is to provide a hole plug system that prevents fluids from leaking through or around an outer perimeter of the plug.

Another object is to provide a hole plug system that may be easily inserted and removed from the hole and/or opening.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
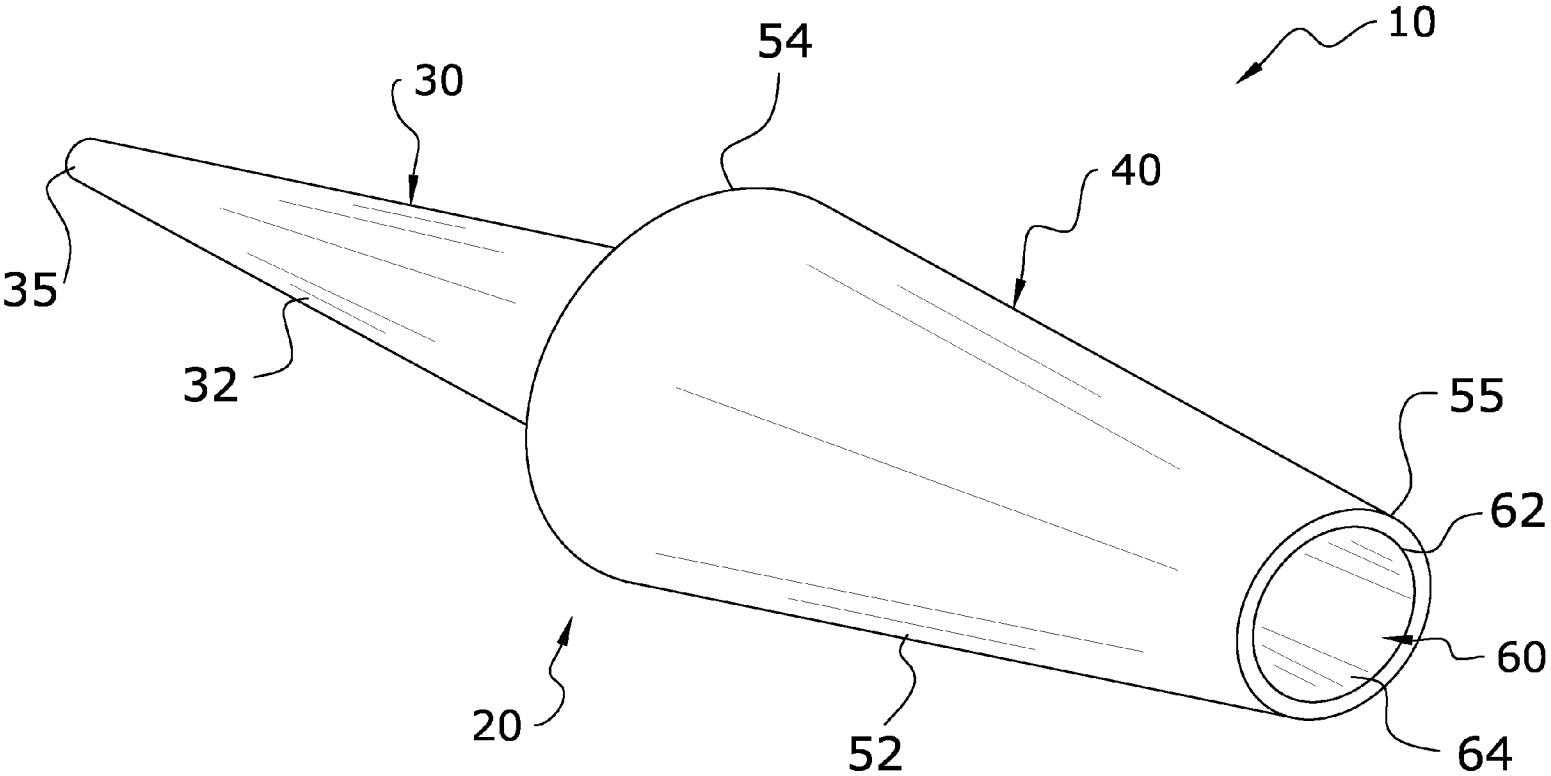
FIG. 1 is an upper perspective view of the present invention from a first direction.
Figure 2:
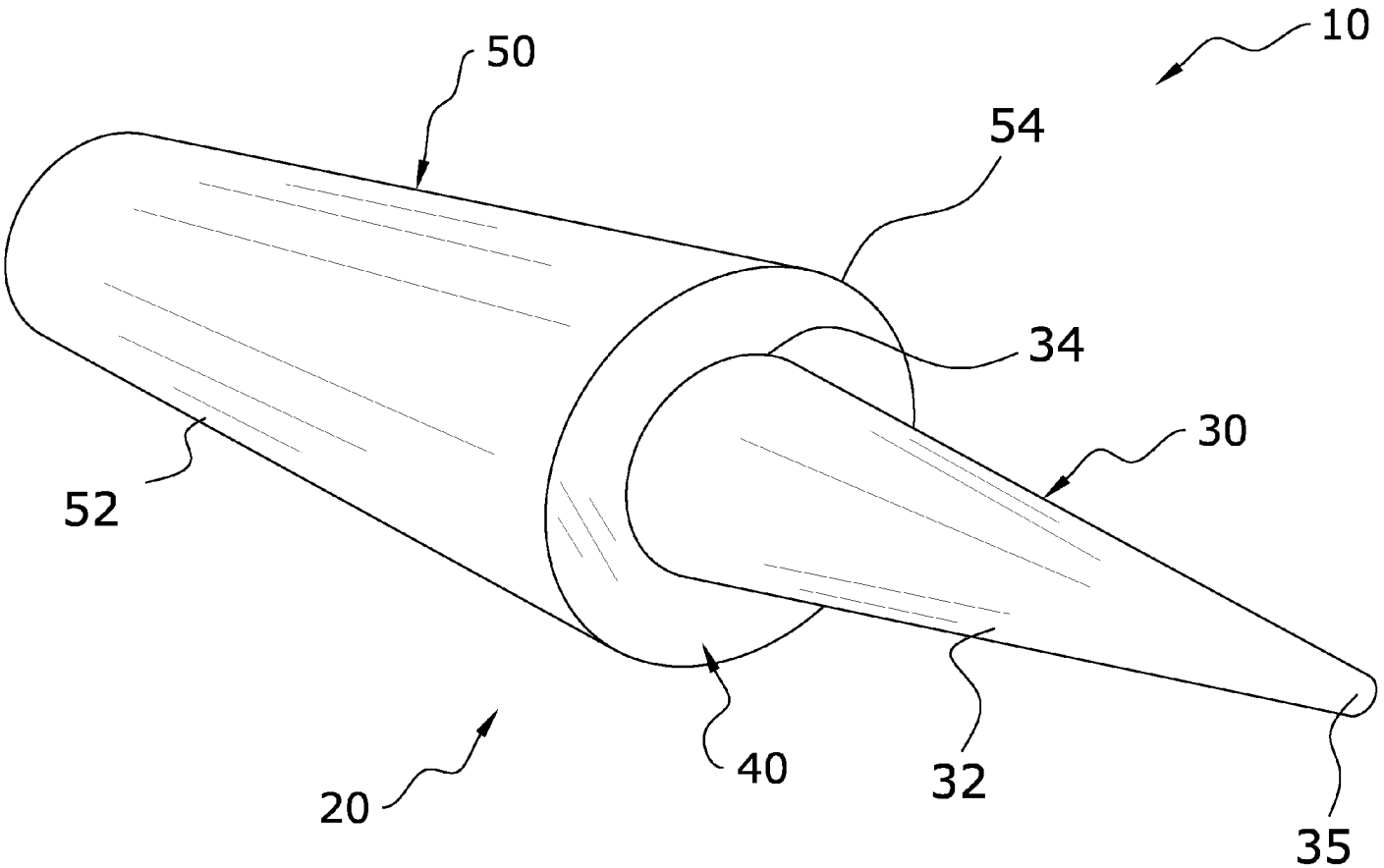
FIG. 2 is an upper perspective view of the present invention from a second direction.

Turning now descriptively to the drawings, in which similar reference characters denote similar elements throughout the several views, the figures illustrate a conical hole plug 10, which comprises a first elongated portion 30 having a first varying diameter that uniformly increases from a terminating outer end 35 to a terminating inner end 34, a second cavity 70 extending within the first elongated portion 30, the second cavity 70 having a second varying diameter that uniformly decreases from a terminating outer end 72 to a terminating inner end 76, a second elongated portion 50 having a third varying diameter that uniformly increases from a terminating outer end 55 to a terminating inner end 54, the second elongated portion 50 linearly extends from the first elongated portion 30, and a first cavity 60 extending within the second elongated portion 50, the first cavity 60 having a fourth varying diameter that uniformly decreases from a terminating outer end 62 to a terminating inner end 66.

The terminating inner end 34 of the first varying diameter is greater than the terminating inner end 54 of the third varying diameter and wherein the terminating outer end 35 of the first varying diameter is greater than the terminating outer end 55 of the third varying diameter. The terminating inner end 76 of the second varying diameter is greater than the terminating inner end 66 of the fourth varying diameter and wherein the terminating outer end 72 of the second varying diameter is greater than the terminating outer end 62 of the fourth varying diameter. The terminating outer end 35, 55 of the first elongated portion 30 and the second elongated portion 50 is comprised of a blunt structure. Additionally, the second cavity 70 is oriented in an opposite direction as the first cavity 60.

B. Auxiliary Structure

The auxiliary structure 12 may be comprised of various types which include a hole 14 or passageway extending through or partially through. Examples of auxiliary structures 12 include a wall, a hose, and various components in fields such as automobile mechanics, fluid power, maintenance, air conditioners, farming, plumbing, painting, sandblasting and various others. The hole 14 may be comprised of various configurations, such as but not limited to threaded, smooth, tapered, uniform diameter, shallow and deep. The hole 14 may further be comprised of various sizes. The present invention may be inserted within the hole 14 (e.g. hole 14 within a wall, etc.) or the auxiliary structure 12 may be inserted within the first cavity 60 or second cavity 70 (e.g. end of a hose, etc.) of the present invention.

C. Plug Structure

The plug structure 20 are to seal holes 14 (e.g. in walls, hoses, machinery, etc.), wherein the plug structure 20 may be utilized to seal various size and configuration holes 14. The plug structure 20 including the first elongated portion 30, the second cavity 70, the second elongated portion 50, and the first cavity 60 is preferably comprised of an integral one-piece structure.

The plug structure 20 is preferably comprised of a soft, resilient, and flexible material, such as rubber, so as to be able to conform to the respective hole 14 that the plug structure 20 is inserted within. The resilient material of the plug structure 20 also prevents fluid (i.e. liquid and gas) from soaking or seeping through the plug structure 20, wherein the plug structure 20 is able to efficiently fluidly seal a respective hole 14. The resilient material also assists the user in grasping the plug structure 20 and maneuvering the plug structure 20 within the hole 14, wherein the rubber material allows the user to securely grip the plug structure 20. It is appreciated however that the plug structure 20 may be comprised of various other types of resilient and flexible materials rather than the preferred embodiment.

i. First Elongated Portion.

Figure 3:
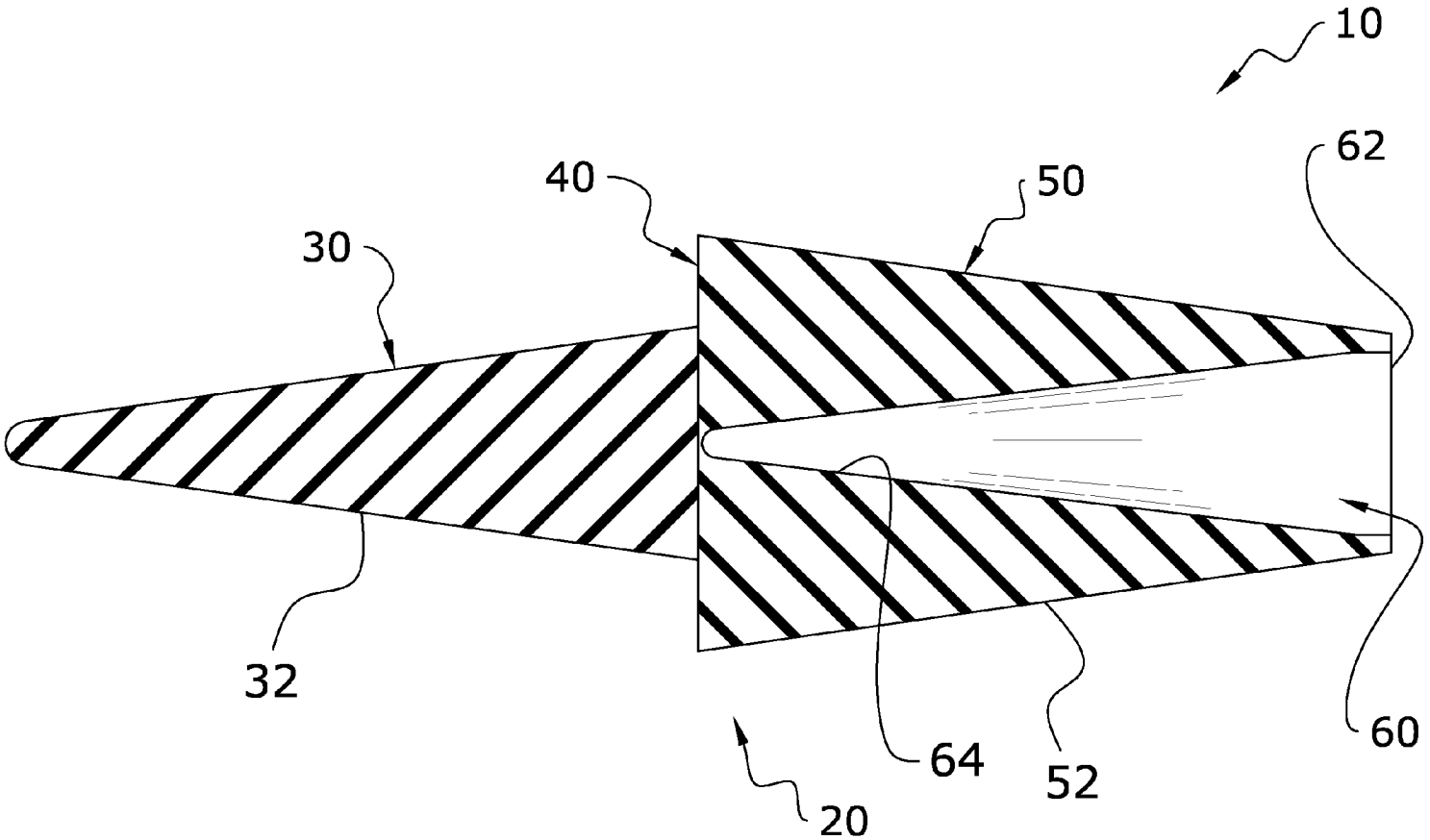
FIG. 3 is a longitudinal cross-sectional view of the present invention.

The first elongated portion 30 is comprised of a varying diameter thickness as illustrated in FIGS. 1 through 11. In the preferred embodiment of the present invention the first elongated portion 30 is comprised of a conical shaped configuration; however it is appreciated that the first elongated portion 30 may be comprised of various types of elongated shapes all of which preferably taper and vary in thickness (e.g. triangular, etc.). The first elongated portion 30 is further preferably comprised of a solid structure as illustrated in FIG. 3.

The first elongated portion 30 includes a first inner end 34 and a first outer end 35 opposite the first inner end 34. A first inner diameter of the first inner end 34 is substantially greater than a first outer diameter of the first outer end 35, wherein the portion between the first inner end 34 and the first outer end 35 is preferably evenly tapered to connect the first inner diameter of the first inner end 34 to the first outer diameter of the first outer end 35 as illustrated in FIGS. 1 through 7.

The first outer end 35 further preferably includes a curved portion forming a substantial point upon the first elongated portion 30, wherein when utilizing the first elongated portion 30 to seal a hole 14 the first outer end 35 is inserted within the hole 14. The first inner end 34 is comprised of a planar configuration to efficiently be positioned against and flush with the second inner end 54 of the second elongated portion 50 at the adjoining portion 40 of the plug 20 as shown in FIGS. 2 through 7. In the improvement, the first outer end 35 may be comprised of a blunt structure similar to the second outer end 55 of the second elongated portion 50 as illustrated in FIGS. 10 and 11.

The first outer surface 32 of the first elongated portion 30 is comprised of a straight and angled configuration and connects the first outer end 35 to the first inner end 34 to define a tapered first elongated portion 30. A first angle defined by the first outer surface 32 and a horizontal axis or concentric longitudinal axis of the present invention is preferably comprised of an acute angle. In the preferred embodiment the first angle is comprised of an approximate 16 degree angle; however it is appreciated that the first angle may be comprised of various degree angles.

ii. Second Cavity.

Figure 8:
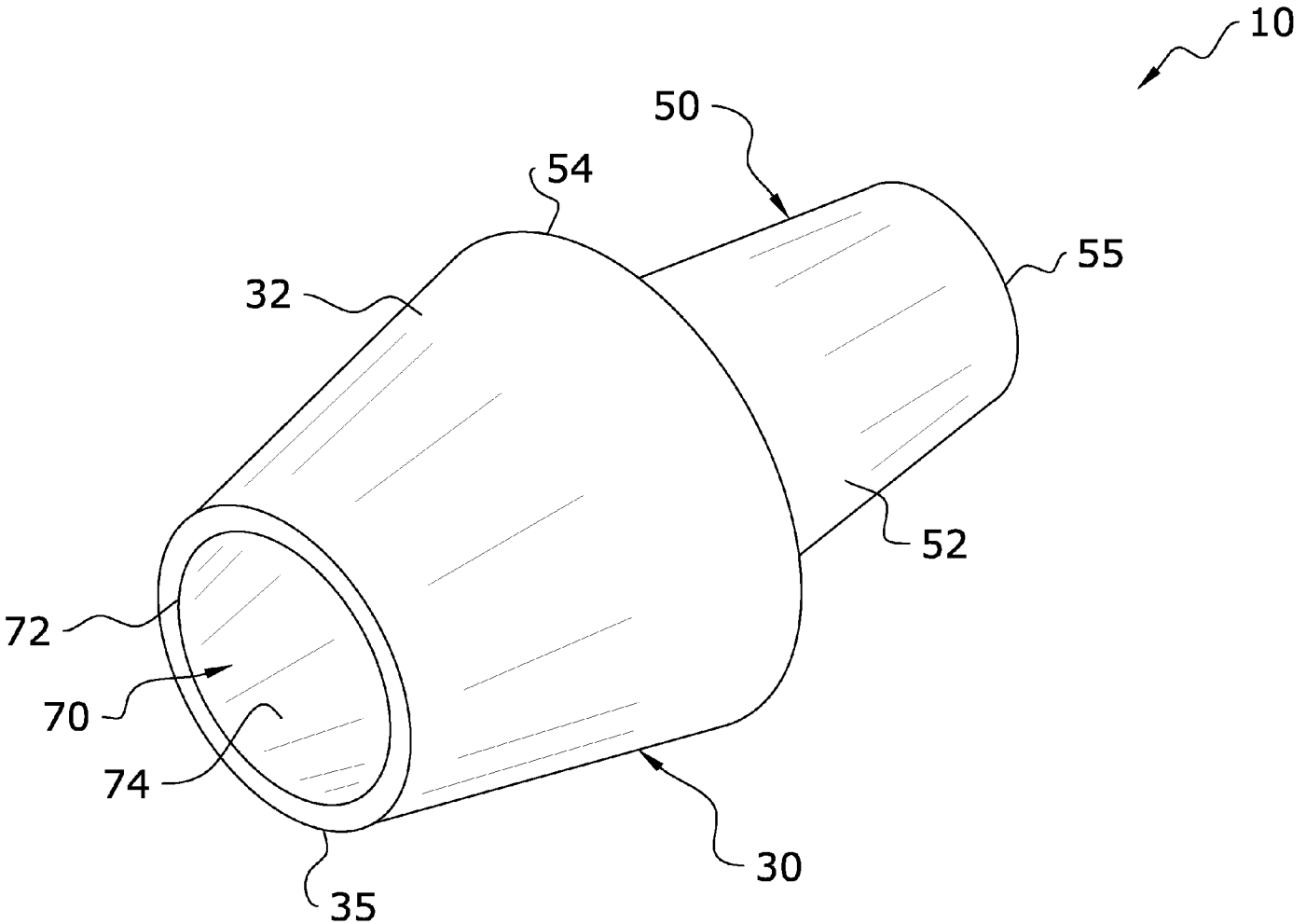
FIG. 8 is a first upper perspective view of the improved conical plug having the second cavity.
Figure 9:
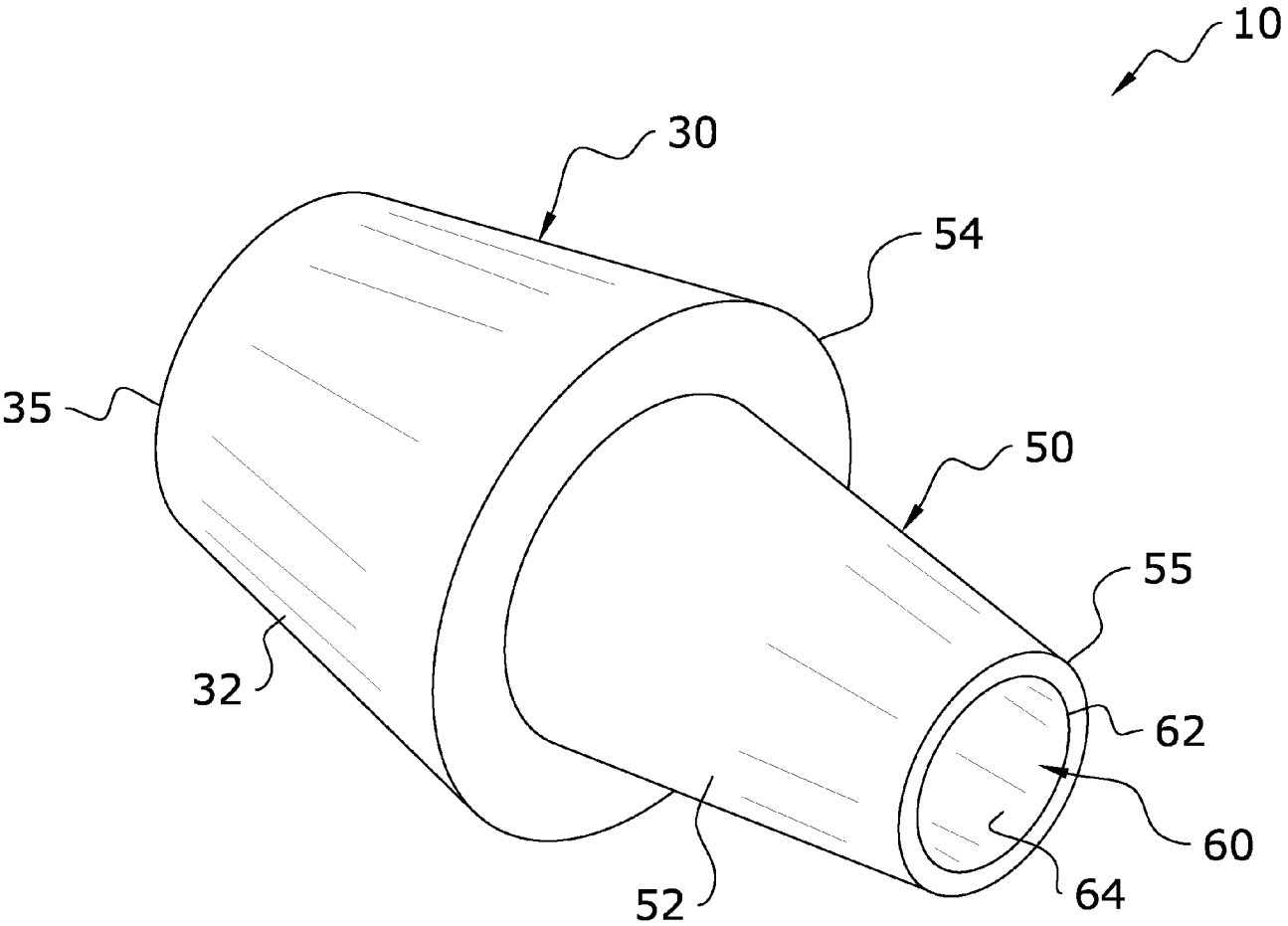
FIG. 9 is a second upper perspective view of the improved conical plug having the second cavity.
Figure 10:
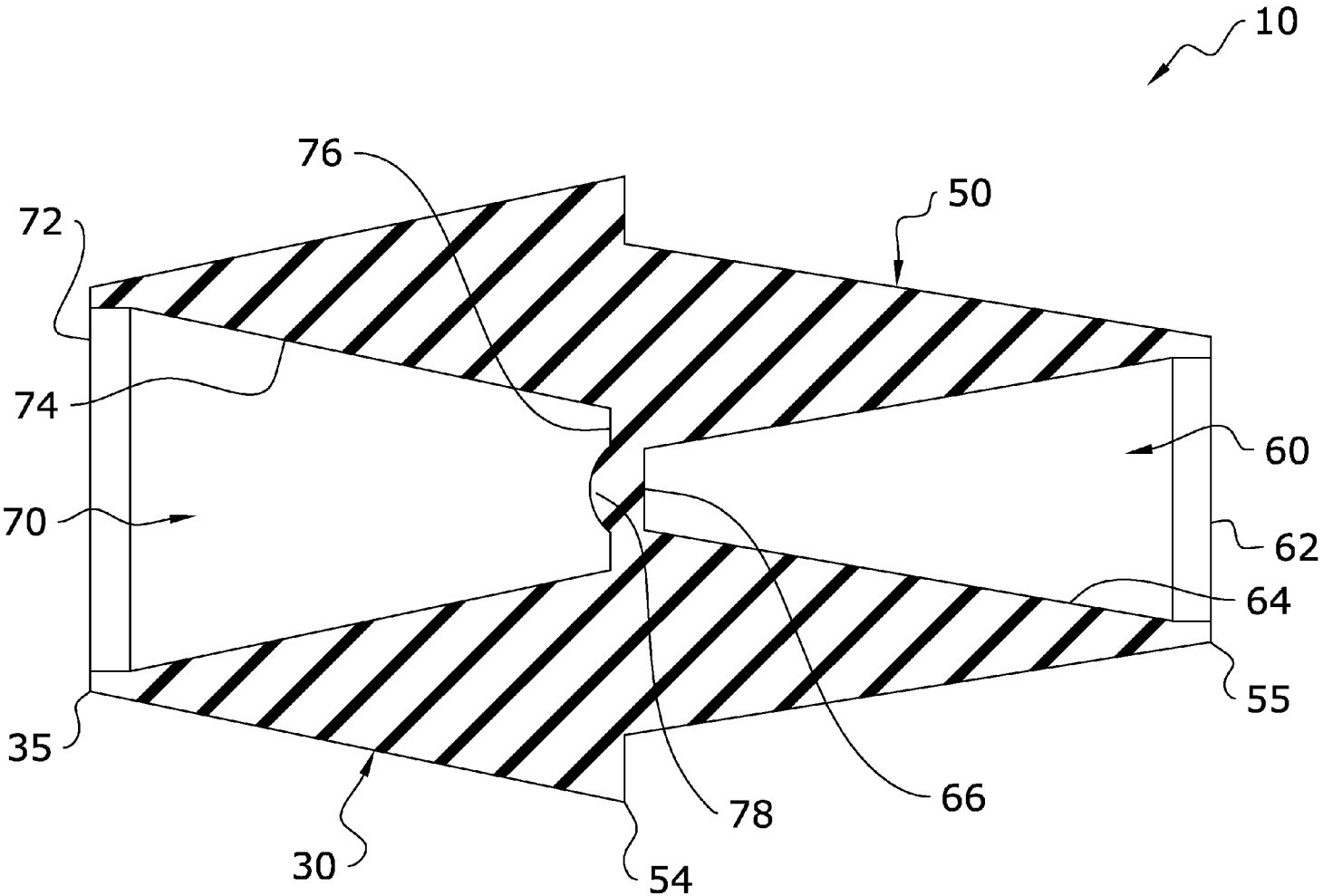
FIG. 10 is a longitudinal cross-sectional view of the improved conical plug having a second cavity with a bulge portion at an inner end.
Figure 11:
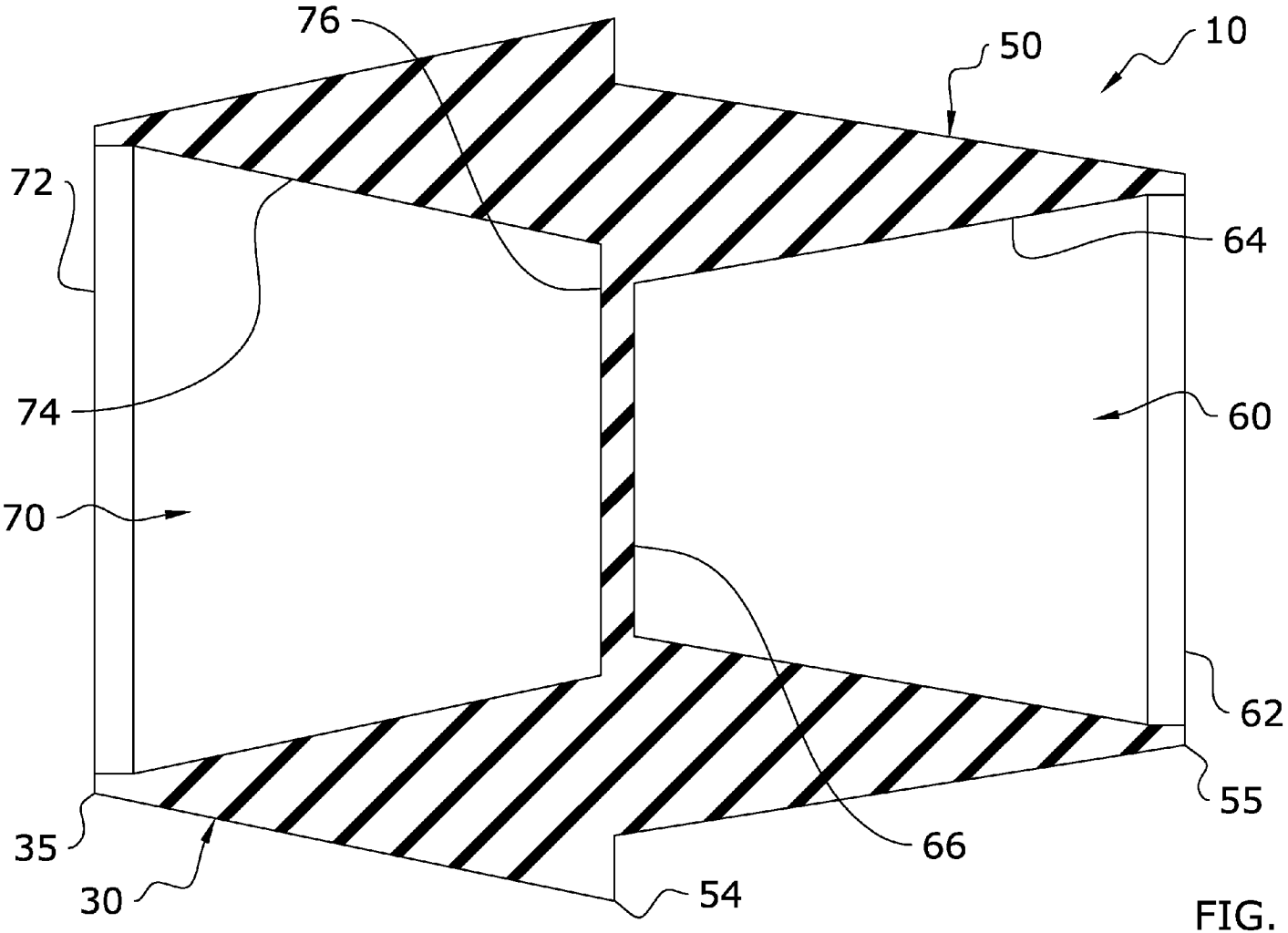
FIG. 11 is a longitudinal cross-sectional view of the improved conical plug having a second cavity with a flat inner end.

The improved present invention also includes a second cavity 70 extending within the first elongated portion 30 towards extends toward the first inner end 76 and adjoining portion 40 as illustrated in FIGS. 8, 10, and 11. The second cavity 70 extends from an opening 72 extending through the first outer end 35 of the first elongated portion 30, wherein the second cavity 70 interconnects with the opening 72. The opening 72 is preferably comprised of circular shaped configuration to receive various size hoses; however it is appreciated that the opening 72 may be comprised of various shaped configurations.

The second cavity 70 is comprised of an elongated configuration and preferably substantially extends an entire longitudinal length of the first elongated portion 30. In the preferred embodiment of the present invention the second cavity 70 is comprised of a conical shaped configuration; however it is appreciated that the second cavity 70 may be comprised of various types of elongated shapes all of which preferably vary in thickness (e.g. triangular, etc.).

The second cavity 70 is further preferably concentric with the first elongated portion 30 and the second elongated portion 50 as illustrated in FIGS. 10 and 11. The second cavity 70 also tapers in an opposing direction as the first elongated portion 30 and a similar direction as the second elongated portion 50. An inner diameter of an inner surface 74 of the cavity 70 preferably evenly tapers toward the first inner end 76 as illustrated in FIGS. 10 and 11.

An angle defined by the inner surface 74 of the second cavity 70 and a horizontal axis or concentric longitudinal axis of the present invention is preferably comprised of a straight or non curved structure of an acute angle. It is appreciated that the angle of the second cavity 70 defined by the inner surface 74 may be comprised of various degree angles. When inserting the auxiliary structure 12 (e.g. hose, etc.) within the second cavity 70, the auxiliary structure 12 engages and slightly pushes outwardly on the inner surface 74 of the second cavity 70 to secure the auxiliary structure 12 within the second cavity 70 and form a tight seal around the auxiliary structure 12 and hole within the auxiliary structure 12.

The inner end 76 of the second cavity 70 adjacent the adjoining portion 40 may be comprised of a flat structure and generally non pointed. In another embodiment, a bulge portion 78 may extend outwardly within the cavity 70 towards the first outer end 35. The bulge portion 78 generally curves outwardly and may be beneficial in forming seals within holes or passageways 14 of auxiliary structures 12. The second cavity 70 may be diametrically similar to the first cavity 60 or larger or smaller. In addition, the angle defined by the inner surface 74 of the second cavity 70 may be equal to, less than, or greater than the angle defined by the inner surface 64 of the first cavity 60.

iii. Second Elongated Portion.

The second elongated portion 50 is comprised of a varying diameter thickness as illustrated in FIGS. 1 through 11. In the preferred embodiment of the present invention the second elongated portion 50 is comprised of a conical shaped configuration; however it is appreciated that the second elongated portion 50 may be comprised of various types of elongated shapes all of which preferably vary in thickness (e.g. triangular, etc.).

Figure 7:
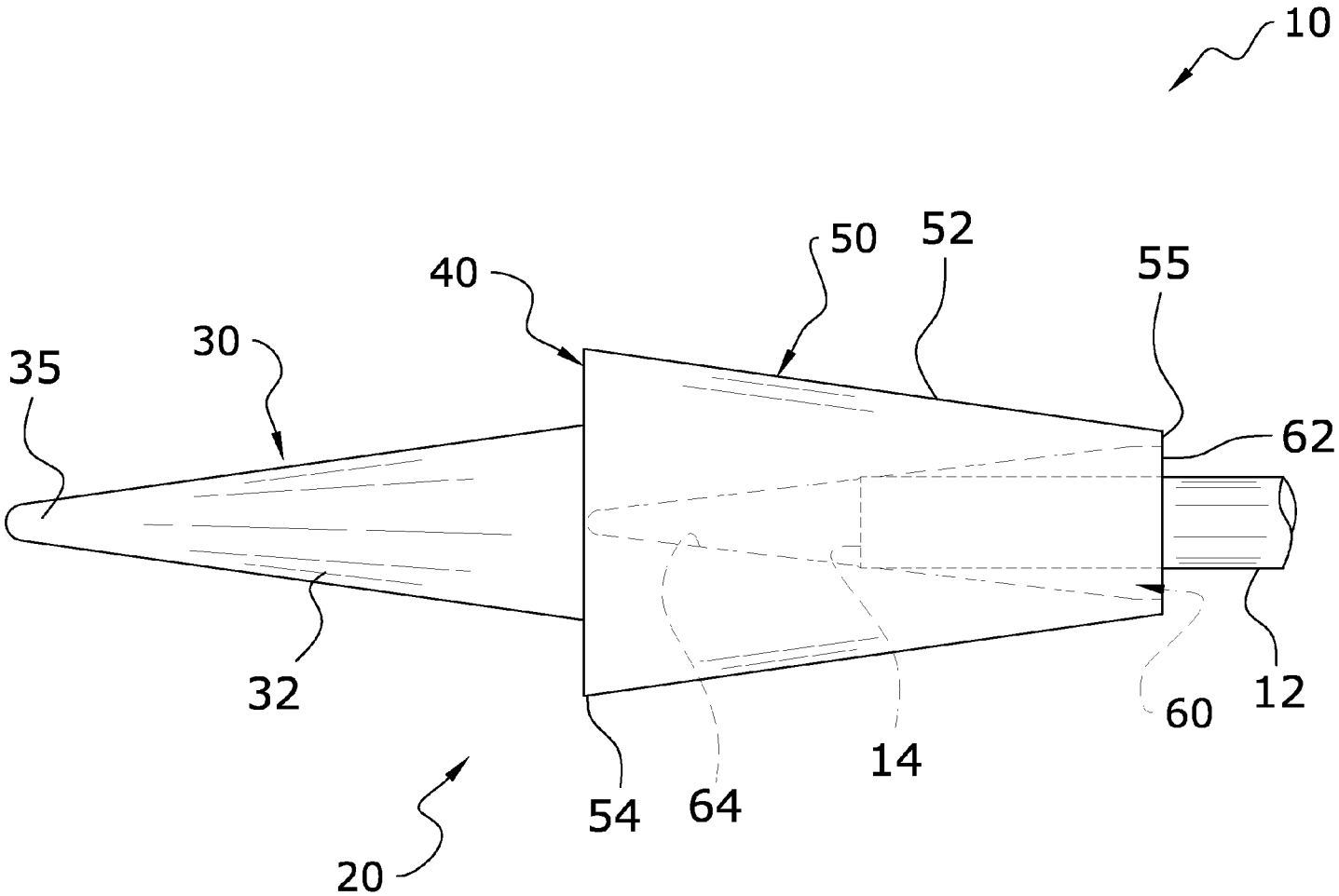
FIG. 7 is a side view of the present invention with the auxiliary structure inserted within the cavity.

The second elongated portion 50 is further preferably comprised of a substantially hollow structure as illustrated in FIGS. 1, 3 and 7. The first elongated portion 30 and the second elongated portion 50 are preferably comprised of an integrally formed structure; however it is appreciated that the first elongated portion 30 and the second elongated portion 50 may be comprised of separate structures fixedly or removably fastened together.

The second elongated portion 50 is further preferably concentric with the first elongated portion 30 as illustrated in FIGS. 1 through 11. The second elongated portion 50 is also directed in an opposing direction as the first elongated portion 30, wherein the user either inserts the first outer end 35 of the first elongated portion 30 within a hole 14 to seal the respective hole 14 with the first elongated portion 30 or inserts the second outer end 55 of the second elongated portion 50 within a hole 14 to seal the respective hole 14 with the second elongated portion 50. The first outer end 35 and the second outer end 55 are further positioned upon opposing ends of the plug 20 and the first inner end 34 and the first outer end 35 are adjacent to each other upon the plug 20.

The second elongated portion 50 includes the second inner end 54 and the second outer end 55 opposite the second inner end 54. A second inner diameter of the second inner end 54 is substantially greater than a second outer diameter of the second outer end 55, wherein the portion between the second inner end 54 and the second outer end 55 is preferably evenly tapered to connect the second inner diameter of the second inner end 54 to the second outer diameter of the second outer end 55 as illustrated in FIGS. 1 through 7.

The second inner diameter of the second inner end 54 is also larger than the first inner diameter of the first inner end 34. The first inner diameter of the first inner end 34 is also substantially similar to the second outer diameter of the second outer end 55, wherein the diameter of the plug 20 becomes increasingly larger from the first outer end 35 to the first inner end 34 and then from the second outer end 55 to the second inner end 54 as illustrated in FIGS. 1 through 7. In the preferred embodiment, the outer diameter of the first elongated portion 30 and the second elongated portion 50 approximately range from ⅛" to 1⅛"; however it is appreciated that the plug 20 may be comprised of various sizes to accommodate various size holes 14.

The second outer end 55 is further preferably comprised of a planar configuration to allow a sufficient size for an opening 62 extending within the second outer end 55. The second inner end 54 is comprised of a planar configuration to efficiently be positioned against and flush with the first inner end 34 of the first elongated portion 30 at the adjoining portion 40 of the plug 20 as illustrated in FIGS. 2 through 7.

The second outer surface 52 of the second elongated portion 50 is comprised of a straight and angled configuration and connects the second outer end 55 to the second inner end 54 to define a tapering second elongated portion 50. A second angle defined by the second outer surface 52 and a horizontal axis or concentric longitudinal axis of the present invention is preferably comprised of an acute angle. In the preferred embodiment the second angle is comprised of an approximate 16 degree angle; however it is appreciated that the second angle may be comprised of various degree angles. The second angle of the second outer surface 52 is further preferably comprised of a substantially similar degree angle as the first angle of the first outer surface 32.

iv. First Cavity.

A first cavity 60 extends within the second elongated portion 50 and extends toward the second inner end 54 and adjoining portion 40 as illustrated in FIGS. 1, 3 and 7. The first cavity 60 extends from an opening 62 extending through the second outer end 55 of the second elongated portion 50, wherein the first cavity 60 interconnects with the opening 62. The opening 62 is preferably comprised of circular shaped configuration to receive various size hoses; however it is appreciated that the opening 62 may be comprised of various shaped configurations.

The first cavity 60 is comprised of an elongated configuration and preferably substantially extends an entire longitudinal length of the second elongated portion 50. In the preferred embodiment of the present invention the first cavity 60 is comprised of a conical shaped configuration; however it is appreciated that the cavity 60 may be comprised of various types of elongated shapes all of which preferably vary in thickness (e.g. triangular, etc.).

The first cavity 60 is further preferably concentric with the first elongated portion 30 and the second elongated portion 50 as illustrated in FIG. 3. The first cavity 60 is also directed in an opposing direction as the second elongated portion 50 and a similar direction as the first elongated portion 30. An inner diameter of an inner surface 64 of the first cavity 60 preferably evenly tapers toward the second inner end 54 as illustrated in FIGS. 3 and 7.

An angle defined by the inner surface 64 of the first cavity 60 and a horizontal axis or concentric longitudinal axis of the present invention is preferably comprised of a straight or non curved structure of an acute angle. The first cavity 60 further comprises a tapering structure. In the preferred embodiment the angle is comprised of an approximate 14 degree angle; however it is appreciated that the angle may be comprised of various degree angles.

When inserting the auxiliary structure 12 (e.g. hose, etc.) within the first cavity 60 the auxiliary structure 12 engages and slightly pushes outwardly on the inner surface 64 of the first cavity 60 to secure the auxiliary structure 12 within the first cavity 60 and form a tight seal around the auxiliary structure 12 and hole 14 within the auxiliary structure 12 as illustrated in FIG. 7. The improvement comprising a flat inner end 66 of the first cavity 60 for receiving wider auxiliary structures 12 is illustrated in FIGS. 10 and 11.

D. Operation of Present Invention

In use, the hole 14 to be sealed and auxiliary structure 12 are first inspected for approximate size to allow the individual to determine if the hole 14 should be sealed with the first elongated portion 30, second elongated portion 50, first cavity 60, or second cavity 70 of the present invention. If the hole 14 is determined to be sealed with the first elongated portion 30 or the second elongated portion 50, the individual grasps the opposing portion (i.e. one not being utilized to seal the hole 14), wherein the opposing portion (i.e. first elongated portion 30, second elongated portion 50) is utilized as a handle.

Figure 4:
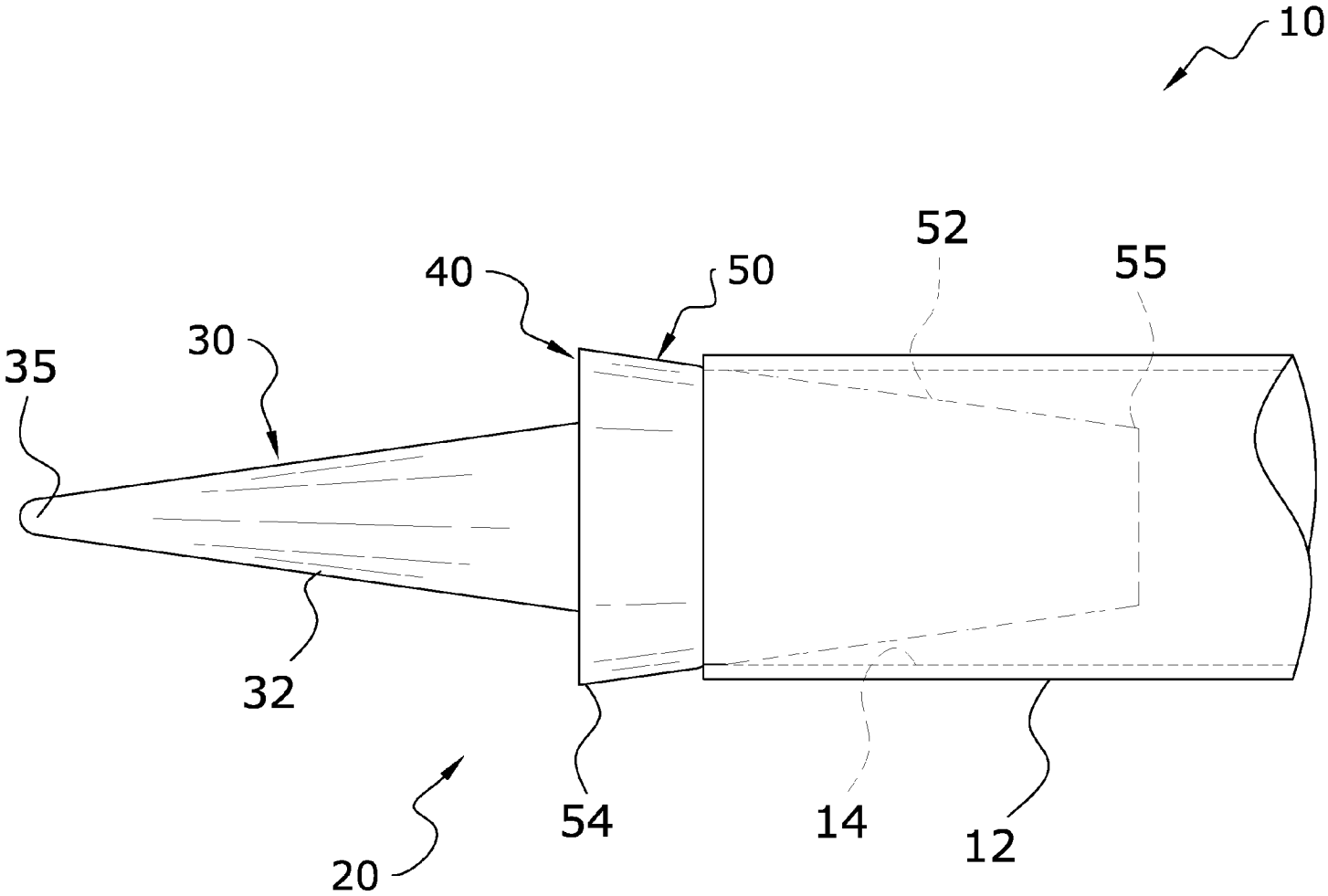
FIG. 4 is a side view of the present invention with the second elongated portion inserted within a hole, wherein the diameter of the hole is slightly smaller than the diameter of the second inner end of the second elongated portion.
Figure 5:
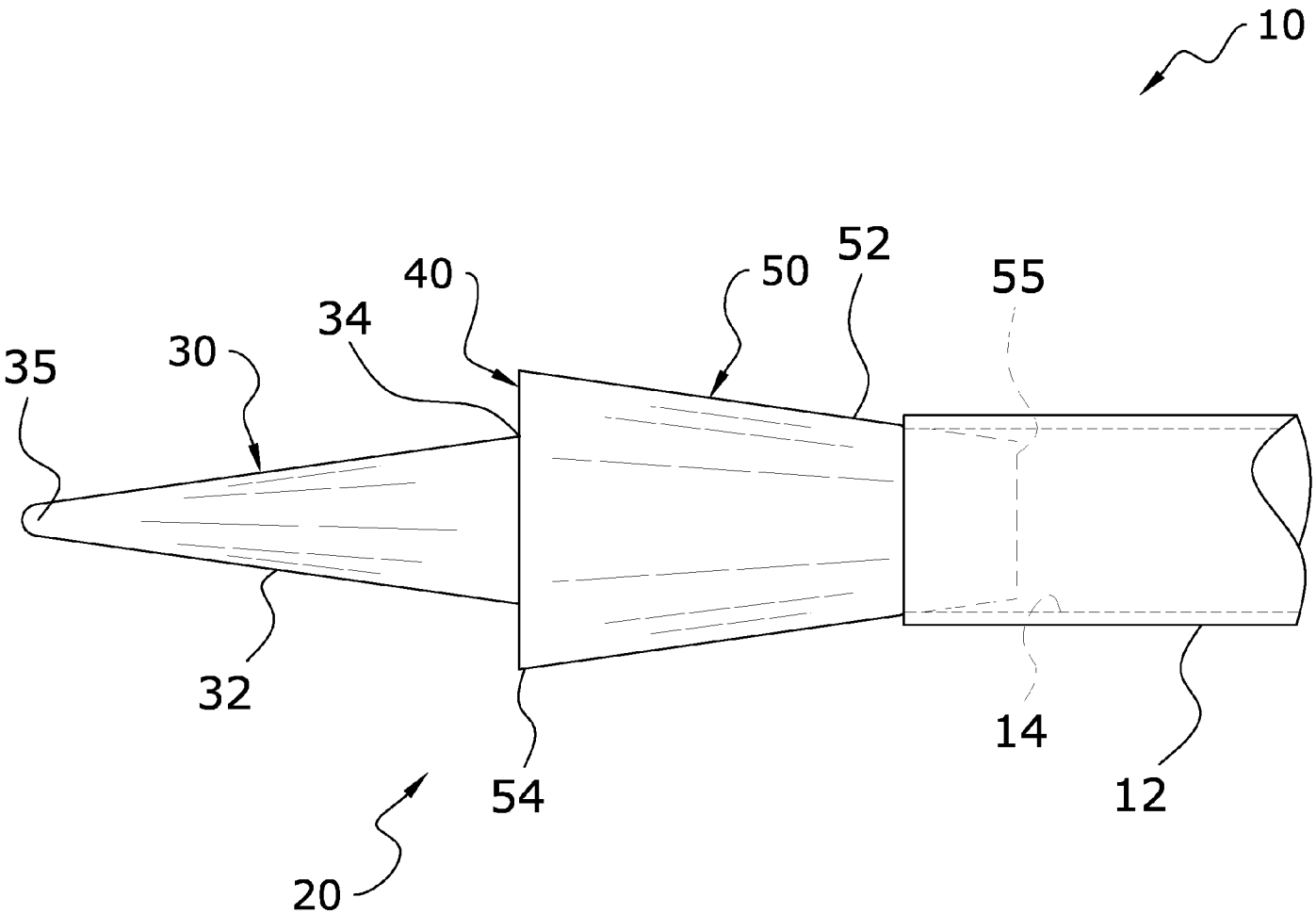
FIG. 5 is a side view of the present invention with the second elongated portion inserted within a hole, wherein the diameter of the hole is slightly larger than the diameter of the second outer end of the second elongated portion.
Figure 6:
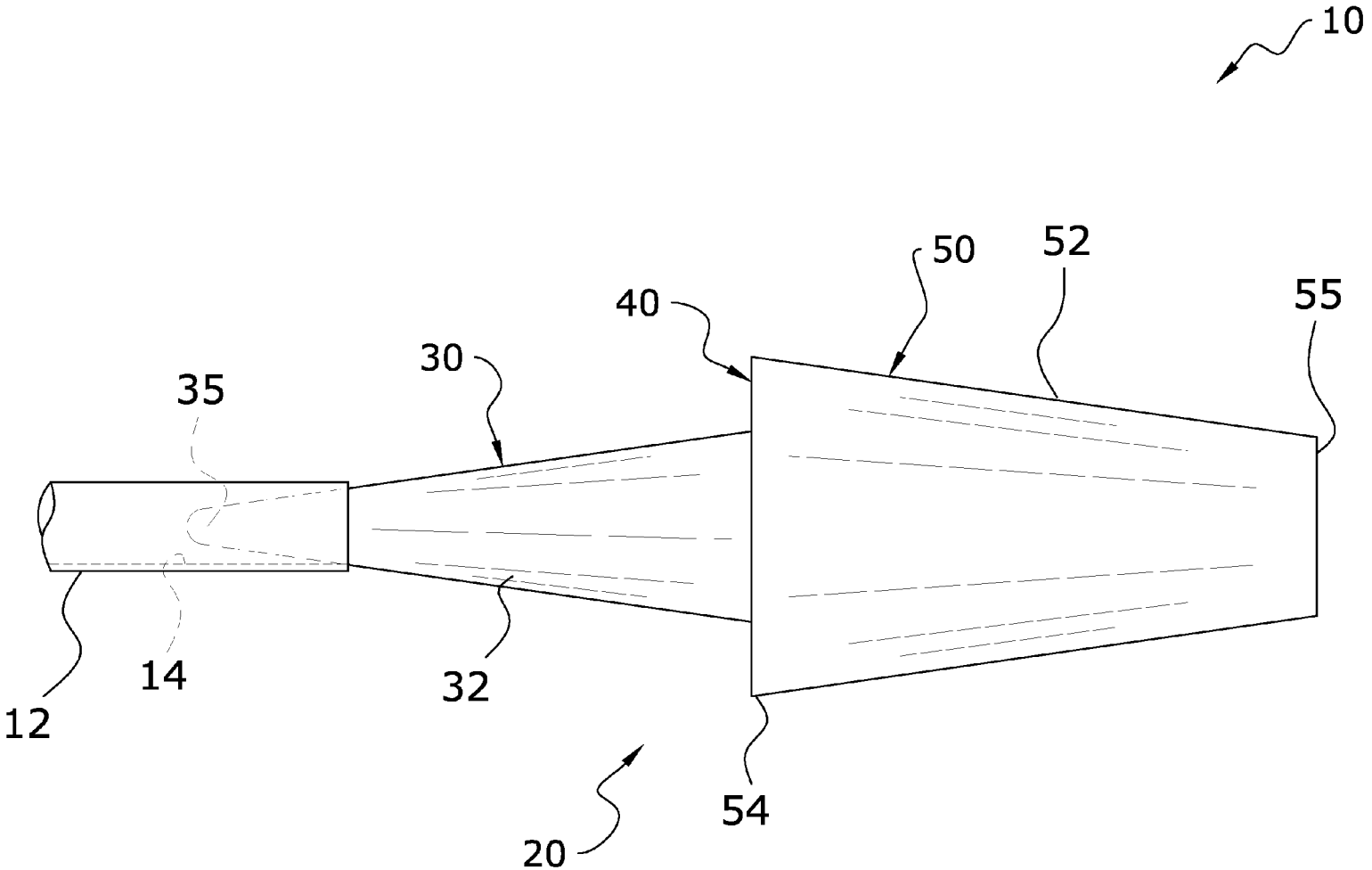
FIG. 6 is a side view of the present invention with the first elongated portion inserted within a hole.

The individual then directs the utilized portion (i.e. first elongated portion 30, second elongated portion 50) within the hole 14 until the utilized portion is securely positioned within the hole 14. The individual now twists and pushes upon (toward the hole 14) the opposing portion to further secure the utilized portion within the hole 14. The hole 14 should now be sealed as illustrated in FIGS. 4 through 6. If the user desires to remove the plug 20 from the hole 14, the previously described process is simply reversed.

If it is determined by the user to utilize the first cavity 60 or second cavity 70 to seal the the auxiliary structure 12, the auxiliary structure 12 is directed within the opening 62 or opening 72 and then the first cavity 60 or second cavity 70 of the respective elongated portion 30, 50. The individual continues to push the auxiliary structure 12 within the first cavity 60 or second cavity 70 until the auxiliary structure 12 is secure within the first cavity 60 or second cavity 70. It is appreciated that the individual may need to twist and push the auxiliary structure 12 (in a similar manner as previously described) within the first cavity 60 or second cavity 70 to achieve a more secure seal between the first cavity 60 or second cavity 70 and the auxiliary structure 12.

It is also appreciated that if the present invention is utilized to seal a shallow hole 14, wherein the first elongated portion 30 or the second elongated portion 50 is too long, the individual may cut off a portion of the first elongated portion 30 or the second elongated portion 50 (i.e. whichever portion is desired to be utilized) to shorten the respective portion 30, 50. The first elongated portion 30 or the second elongated portion 50 may now be inserted within the hole 14 in a manner similar to as previously described.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A conical hole plug, comprising:

a first elongated portion having a first varying diameter that uniformly increases from a terminating outer end to a terminating inner end;

a second cavity extending within said first elongated portion;

said second cavity having a second varying diameter that uniformly decreases from a terminating outer end to a terminating inner end;

a second elongated portion having a third varying diameter that uniformly increases from a terminating outer end to a terminating inner end;

said second elongated portion linearly extends from said first elongated portion; and a first cavity extending within said second elongated portion;

said first cavity having a fourth varying diameter that uniformly decreases from a terminating outer end to a terminating inner end.

2. The conical hole plug of claim 1, wherein said terminating inner end of said second cavity and said first cavity is flat.

3. The conical hole plug of claim 1, wherein said second cavity has a bulge portion along said terminating inner end of said second cavity.

4. The conical hole plug of claim 3, wherein said bulge portion is curved.

5. The conical hole plug of claim 1, wherein said terminating outer end of said first elongated portion and said second elongated portion is comprised of a blunt structure.

6. The conical hole plug of claim 1, wherein said second cavity is oriented in an opposite direction as said first cavity.

7. The conical hole plug of claim 1, wherein said terminating inner end of said second varying diameter is greater than said terminating inner end of said fourth varying diameter and wherein said terminating outer end of said second varying diameter is greater than said terminating outer end of said fourth varying diameter.

8. The conical hole plug of claim 7, wherein said terminating inner end of said first varying diameter is greater than said terminating inner end of said third varying diameter and wherein said terminating outer end of said first varying diameter is greater than said terminating outer end of said third varying diameter.

9. The conical hole plug of claim 1, comprised of an integral one-piece structure.

10. An integral one-piece conical hole plug, comprising:

a first elongated portion having a conical structure;

a first cavity extending within said first elongated portion, said first cavity having a conical structure, said first cavity inverted from said first elongated portion;

a second elongated portion having a conical structure, said second elongated portion linearly extending from said first elongated portion, said second elongated portion inverted from said first elongated portion; and a second cavity extending within said second elongated portion, said second cavity having a conical structure, said second cavity inverted from said second elongated portion.

11. The integral one-piece conical hole plug of claim 10, said first elongated portion having a linear tapering exterior diameter along a first longitudinal length of said first elongated portion, said first cavity having a linear tapering interior diameter along a second longitudinal length of said first cavity, said second elongated portion having a linear tapering exterior diameter along a third longitudinal length of said second elongated portion, and said second cavity having a linear tapering interior diameter along a fourth longitudinal length of said second cavity.

12. The integral one-piece conical hole plug of claim 10, wherein said terminating inner end of said second cavity and said first cavity is flat.

13. The integral one-piece conical hole plug of claim 10, wherein said second cavity has a bulge portion along said terminating inner end of said second cavity.

14. The integral one-piece conical hole plug of claim 13, wherein said bulge portion is curved.

15. The integral one-piece conical hole plug of claim 10, wherein said terminating outer end of said first elongated portion and said second elongated portion is comprised of a blunt structure.

16. The integral one-piece conical hole plug of claim 10, wherein said second cavity is oriented in an opposite direction as said first cavity.

17. The integral one-piece conical hole plug of claim 10, wherein said terminating inner end of said second varying diameter is greater than said terminating inner end of said fourth varying diameter and wherein said terminating outer end of said second varying diameter is greater than said terminating outer end of said fourth varying diameter.

18. The integral one-piece conical hole plug of claim 17, wherein said terminating inner end of said first varying diameter is greater than said terminating inner end of said third varying diameter and wherein said terminating outer end of said first varying diameter is greater than said terminating outer end of said third varying diameter.

19. An integral one-piece conical hole plug, comprising:

a first elongated portion having a first varying diameter that uniformly increases from a terminating outer end to a terminating inner end;

a second cavity extending within said first elongated portion;

said second cavity having a second varying diameter that uniformly decreases from a terminating outer end to a terminating inner end;

a second elongated portion having a third varying diameter that uniformly increases from a terminating outer end to a terminating inner end;

said second elongated portion linearly extends from said first elongated portion; and a first cavity extending within said second elongated portion;

said first cavity having a fourth varying diameter that uniformly decreases from a terminating outer end to a terminating inner end;

wherein said terminating inner end of said first varying diameter is greater than said terminating inner end of said third varying diameter and wherein said terminating outer end of said first varying diameter is greater than said terminating outer end of said third varying diameter;

wherein said terminating inner end of said second varying diameter is greater than said terminating inner end of said fourth varying diameter and wherein said terminating outer end of said second varying diameter is greater than said terminating outer end of said fourth varying diameter;

wherein said terminating outer end of said first elongated portion and said second elongated portion is comprised of a blunt structure;

wherein said second cavity is oriented in an opposite direction as said first cavity.

* * * * *